US005565974A

United States Patent [19]

Harris

[11] Patent Number: 5,565,974

[45] Date of Patent: Oct. 15, 1996

[54] PENTA-LEVEL XEROGRAPHIC UNIT

[75] Inventor: Ellis D. Harris, Claremont, Calif.

[73] Assignee: Xerox Corporation, Stamford, Conn.

[21] Appl. No.: 422,203

[22] Filed: Mar. 31, 1995

[51] Int. Cl.[6] ..... G03G 15/01

[52] U.S. Cl. ..... 355/326 R; 355/210; 355/327

[58] Field of Search ..... 355/208, 210, 355/245, 326 R, 327, 328; 347/119, 129

[56] References Cited

U.S. PATENT DOCUMENTS 5,194,351 3/1993 Roller ..... 355/326 R
5,221,954 6/1993 Harris ..... 355/327
5,223,906 6/1993 Harris ..... 355/326 R
5,305,070 4/1994 Snelling ..... 355/326 R

*Primary Examiner*—Sandra L. Brase
*Attorney, Agent, or Firm*—William Propp

[57] ABSTRACT

A penta-level xerographic unit produces five exposure levels on a photoreceptor. The five exposure levels select between a subtractive and an adjacent additive primary color in both the CAD and DAD operational regimes of a xerographic process. Exposure levels intermediate between the CAD and the DAD result in white. The selection of two possible colors in CAD, or two possible colors in DAD, or the selection of no toner yields a possibility of five colors. This penta-level xerographic unit can be used for a K+3 reduced color gamut printer, typically cyan, yellow and red plus black.

10 Claims, 3 Drawing Sheets

FIG. 2
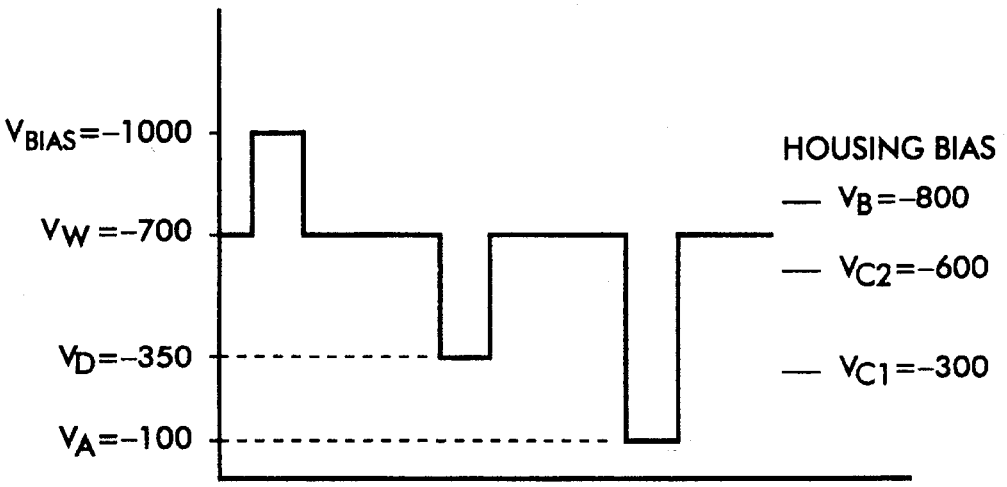
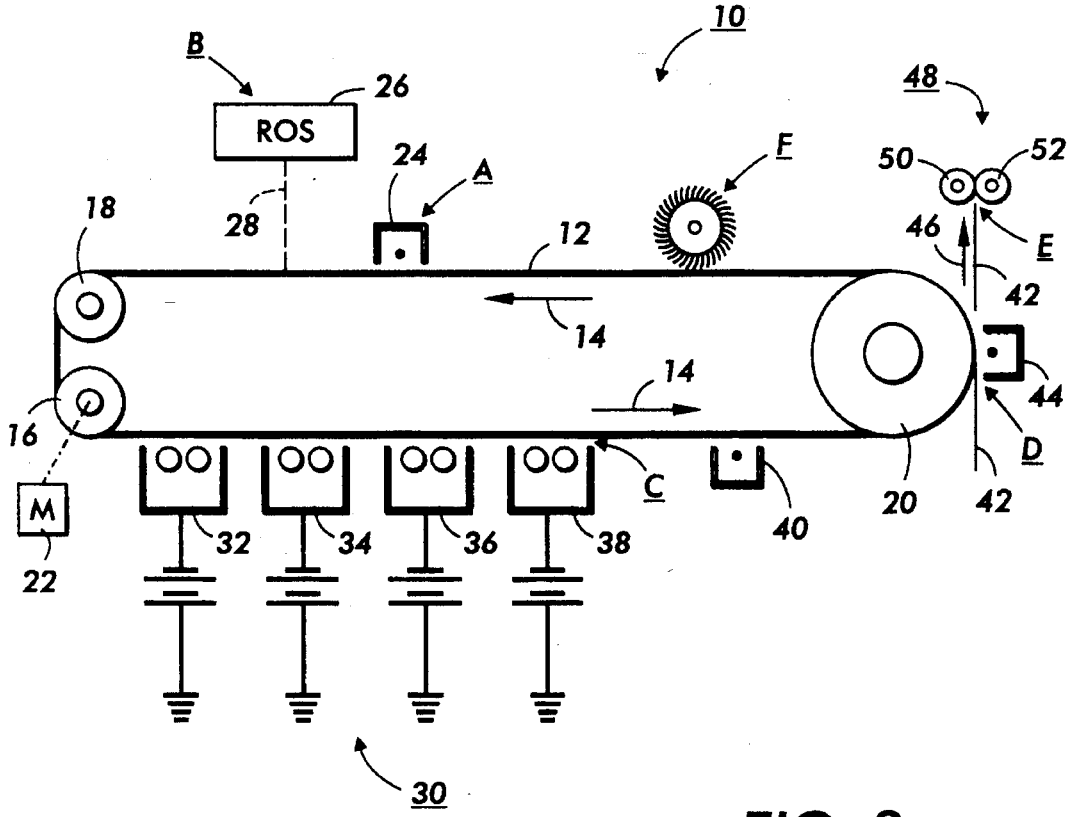
FIG. 3

PENTA-LEVEL XEROGRAPHIC UNIT

CROSS-REFERENCE TO RELATED APPLICATIONS

This application contains subject matter that is related to subject matter of patent application Ser. No. 08/422,197 filed contemporaneously, commonly assigned to the same assignee herein and herein incorporated by reference.

BACKGROUND OF THE INVENTION

The present invention relates generally to a xerographic unit and, more particularly, to a penta-level xerographic unit which produces five voltage levels on a photoreceptor with both Charge Area Development (CAD) and Discharge Area Development (DAD) for depositing toner of five colors.

In the practice of conventional bi-level xerography, it is the general procedure to form electrostatic latent images on a charge retentive surface such as a photoconductive member by first uniformly charging the charge retentive surface. The electrostatic charge is selectively dissipated in accordance with a pattern of activating radiation, such as a light beam, corresponding to original images. The selective dissipation of the charge leaves a bi-level latent charge pattern on the imaging surface where the high charge regions correspond to the areas not exposed by radiation. One level of this charge pattern is made visible by developing it with toner. The toner is generally a colored powder that adheres to the charge pattern by electrostatic attraction. The developed image is then fixed to the imaging surface, or is transferred to a receiving substrate such as plain paper, to which it is fixed by suitable fusing techniques.

In tri-level, highlight color imaging, unlike conventional xerography, upon exposure, three charge levels are produced on the charge-retentive surface. The highly charged (i.e. unexposed) areas are developed with toner, and the area more fully discharged is also developed, but with a toner of a different color. The area with an intermediate exposure is not developed. Thus, the charge retentive surface contains three exposure levels; zero exposure, intermediate exposure, and full exposure, which correspond to three charge levels. These three levels can be developed to print, for example, black, white, and a single color.

In the tri-level xerographic unit, as illustrated in prior art FIGS. 1A and 1B, a photoconductive belt consisting of a photoconductive surface on an electrically conductive, light-transmissive substrate is charged to a selectively high uniform positive or negative potential, $V_0$.

The uniformly charged surface of the photoconductive belt is exposed by a tri-level raster output scanner (ROS), which causes the charge retentive surface to be discharged in accordance with the output from the scanning device. This scan results in three separate discharge regions on the photoreceptor, each region exposed at one of three possible levels: (1) zero exposure which results in a voltage equal to $V_{ddp}$ and will be developed using charged-area-development (CAD); (2) full exposure, which results in a low voltage level $V_C$ and is developed using discharged-area-development (DAD); and (3) intermediate exposure, which yields an intermediate voltage level $V_W$ and does not develop and yields a white region on the print. These voltage levels are shown schematically in FIGS. 1A and 1B.

The photoreceptor, which is initially charged to a voltage $V_0$, undergoes dark decay to a level $V_{ddp}$ ($V_{CAD}$) equal to about minus 900 volts in this illustrative example. When exposed at an exposure station, the photoreceptor is discharged to $V_c$, ($V_{DAD}$) equal to about minus 100 volts in the highlight (i.e. color other than black) color portions of the image. The photoreceptor is also discharged to $V_w$ ($V_{white}$) equal to minus 500 volts imagewise in the background (i.e. white), image areas and in the inter-document area. Thus the image exposure is at three levels; zero exposure (i.e. black), intermediate exposure (white) and full exposure (i.e. color). After passing through the exposure station, the photoreceptor contains highly charged areas and fully discharged areas which correspond to CAD and DAD color latent images, and also contains an intermediate level charged area that is not developed.

A development system advances developer materials into contact with the CAD and DAD electrostatic latent images. The development system in a tri-level xerographic unit comprises a first and second developer. The first developer brings developer material, by way of example, positively charged black toner, into contact with the photoreceptor for developing the charged-area regions ($V_{CAD}$). A suitable DC electrical bias, $V_{bb}$, of approximately minus 600 volts is applied to the first developer.

The second developer brings developer material, by way of example, negatively charged red toner, into contact with the photoreceptor for developing the discharged-area regions ($V_{DAD}$). A suitable DC bias, $V_{cb}$, of approximately minus 400 volts is applied to the second developer.

An illustrative example of a tri-level xerographic unit is found in U.S. Pat. No. 4,990,955, assigned to the same assignee as the present invention and herein incorporated by reference.

There are several scanning techniques known in the prior art to obtain the tri-level exposure imaging. A conventional flying spot scanner, such as used in the Canon 9030 uses a ROS unit to "write" an exposed image on a photoreceptive surface a pixel at a time. To obtain higher spatial resolution, a pulse imaging scanner can be utilized. This pulse imaging scanner is also referred to as a Scophony scanner in an article in Optical Engineering, Vol. 24, No. 1, January/February 1985, *Scophony Spatial Light Modulator*, by Richard Johnson et al., whose contents are hereby incorporated by reference. A preferred technique, capable of higher spatial resolution is to use similar optical elements as the flying spot scanner (rotating polygon, laser light source, pre-polygon and post-polygon optics), but with an A/O modulator which illuminates many pixels at a given time, resulting in a scanner with a coherent imaging response. With this type of scan system, the exposure level, or levels at the image surface, can be controlled by controlling the drive level of the A/O modulator dependent on the video data. In a tri-level system, two drive levels are used, one for the white exposure and a second higher drive level for the DAD exposure.

Alternately, instead of obtaining an intermediate exposure level by controlling the acoustic amplitude, an intermediate exposure can be provided by using pulse width modulation in a pulse imaging system in conjunction with spatial filtering.

In quad-level or four-level color imaging, upon exposure, four charge levels are produced on the charge-retentive surface. Thus, the charge retentive surface contains four exposure levels; zero exposure, a low intermediate exposure, a high intermediate exposure and full exposure, which correspond to the four charge levels. These three levels can be developed to print, for example, black, white, and two colors.

In the quad-level xerographic unit, as illustrated in prior art FIG. 2, a photoconductive belt consisting of a photoconductive surface on an electrically conductive, light-transmissive substrate is charged to a selectively high uniform positive or negative potential, $V_0$.

The uniformly charged surface of the photoconductive belt is exposed by a quad-level raster output scanner (ROS), which causes the charge retentive surface to be discharged in accordance with the output from the scanning device.

The photoconductive belt, which is initially charged to a voltage $V_0$ (approximately minus 1000 volts), is discharged to $V_w$ (approximately minus 700 volts) imagewise in the background (white) image areas and to $V_d$ (approximately minus 350 volts) and $V_a$ (approximately minus 100 volts) in the highlight (i.e. colors other than black)image areas.

A development station advances developer materials into contact with the electrostatic latent images on the photoconductive belt. The development system in a quad-level xerographic unit comprises a first, second and third developer.

The black toner from the first developer is attracted to the $V_0$ voltage areas on the photoreceptor and repelled from the other two charged areas, $V_d$ and $V_a$. The positively charged black toner from the first developer is attracted to the $V_0$ voltage areas on the photoreceptor belt which are at a charge level of minus 1000 volts since the bias on the first developer is minus 800 volts. The positively charged black toner is attracted to the photoreceptor areas which are more negative than the developer housing. Conversely the positively charged black toner from the first developer housing is not attracted to the photoreceptor areas, $V_d$ (approximately minus 350 volts) and $V_a$ (approximately minus 100 volts), that are more positive than the first developer housing bias of minus 800 volts.

The magenta toner from the second developer is attracted to the $V_a$ voltage areas on the photoreceptor and repelled from the other two charged areas, $V_d$ and $V_0$. The voltage level $V_a$ of minus 100 volts is less negative than the minus 300 volts of the second developer housing and the negative charge of the magenta toner. The magenta toner is not attracted to the photoreceptors areas of voltage levels $V_d$ of minus 350 volts because these areas are more negative than the minus 300 volts bias of the second developer housing and thus repel the magenta toner.

The cyan toner from the third developer is attracted to both the $V_a$ and the $V_d$ voltage areas on the photoreceptor. The voltage levels of $V_d$ of minus 350 volts and $V_a$ of minus 100 volts are both more positive than the minus 600 volts bias of the third developer and the negatively charged cyan toner.

Thus, the $V_0$ voltage areas on the photoreceptor attracts the black toner from the first developer to produce a black color image. The $V_d$ voltage areas on the photoreceptor attracts the cyan toner from the third developer housing 130 to produce a cyan color image. The $V_a$ voltage areas photoreceptor attracts the magenta toner from the second developer and the cyan toner from the third developer to produce a blue color image. The areas of the photoreceptor charged to $V_w$ of minus 700 volts are not developed by any of the toners because the biasing of the toner housings and the polarities of the toners.

Thus, the quad-level xerographic unit, where the voltages of the color highlight areas on the photoreceptor and the color developer biases are between the white voltage level and ground, will produce black, white, cyan (the color of the toner whose housing bias is closest to white) and blue (a mixture of cyan and magenta).

An illustrative example of a quad-level xerographic unit is found in U.S. Pat. Nos. 4,731,634 and 5,155,541, commonly assigned with this application and herein incorporated by reference.

A quad-level xerographic unit, unlike the bi-level and tri-level, may not produce color images that match the toner colors. Two of the toner colors are produced while the third color produced is a combination of one of those first two toner colors and a third toner color.

There are alternate quad-level xerographic units for carrying out the desired formation of three different color pixels on the photoreceptor means of the present invention. Some of these alternatives, such as U.S. Pat. No. 5,049,949, assigned to the same assignee as the present invention and herein incorporated by reference, do not use the combining of two color toners to form a third color pixel on the photoreceptor means, but rather directly deposit three different color toners upon the photoreceptor means without combination.

It is an object of this invention to provide a penta-level xerographic unit for produces five voltage levels on a photoreceptor with both Charge Area Development (CAD) and Discharge Area Development (DAD) for depositing toner of five colors.

SUMMARY OF THE INVENTION

In accordance with the present invention, a penta-level xerographic unit produces five exposure levels on a photoreceptor. The five exposure levels select between a subtractive and an adjacent additive primary color in both the CAD and DAD operational regimes of a xerographic process. Exposure levels intermediate between the CAD and the DAD result in white. The selection of two possible colors in CAD, or two possible colors in DAD, or the selection of no toner yields a possibility of five colors. This penta-level xerographic unit can be used for a K+3 reduced color gamut printer, typically cyan, yellow and red plus black.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 2 shows the four voltage discharge levels obtained by the exposure system of a prior art quad-level xerographic unit imaging system.

FIG. 3 is a schematic view of the color printing system using a penta-level xerographic unit formed according to the present invention.

DESCRIPTION OF THE PREFERRED EMBODIMENT

Figure 1A:
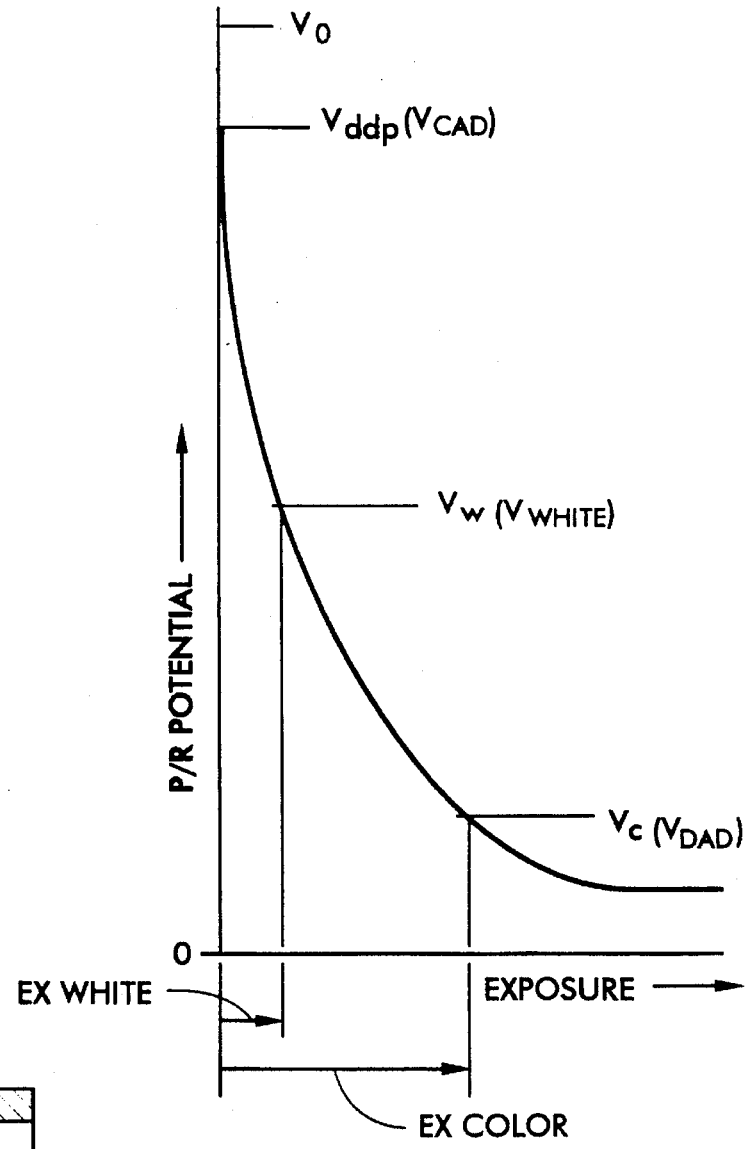
PRIOR ART FIG. 1A
FIGS. 1A and 1B show the three voltage discharge levels obtained by the exposure system of a prior art tri-level xerographic unit imaging system.
Figure 1B:
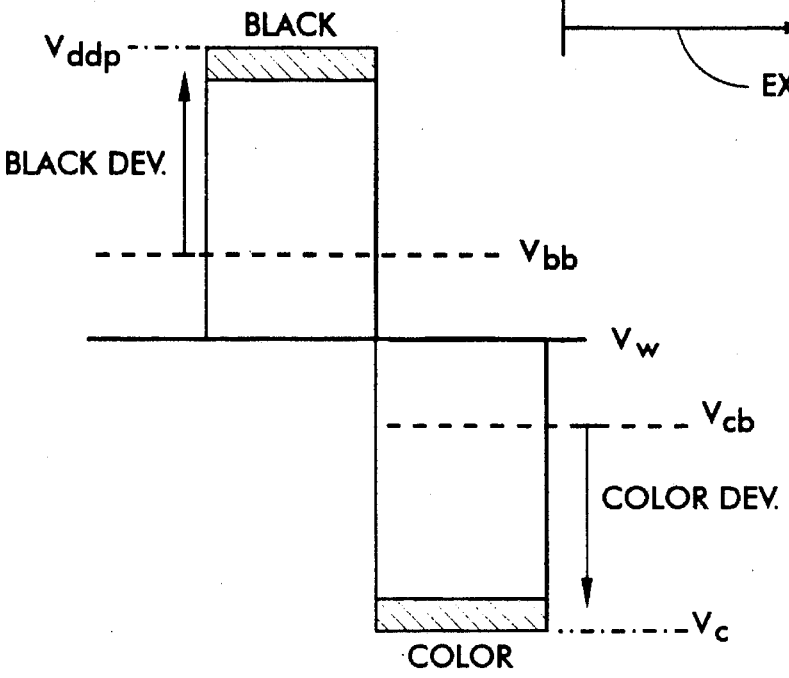
PRIOR ART FIG. 1B

Reference is now made to FIG. 3, wherein there is illustrated a xerographic printing system 10 incorporating the present invention which may utilize a charge retentive member in the form of a photoconductive belt 12 consisting of a photoconductive surface and an electrically conductive substrate. The photoconductive belt is mounted for movement past a charging station A, an exposure station B, a development station C, a transfer station D, a fusing station E and a cleaning station F. The photoconductive belt 12 moves in the direction of arrow 14 to advance successive portions of the photoconductive belt sequentially through the various processing stations disposed about the path of movement thereof for forming images in a single pass of the photoconductive belt through all of the process stations. The photoconductive belt 12 is entrained about a plurality of rollers 16, 18 and 20, the former of which can be used as a drive roller and the latter of which can be used to provide suitable tensioning of the photoreceptor belt 12. A motor 22 rotates roller 16 to advance the photoconductive belt 12 in the direction of arrow 14. The drive roller 16 is coupled to motor 22 by suitable means such as a belt drive.

As can be seen by further reference to FIG. 3, initially successive portions of belt 12 pass through charging station A, where a corona discharge device such as a scorotron, corotron, or dicorotron, indicated generally by the reference numeral 24, charges the belt 10 to a selectively high uniform positive or negative potential, $V_0$. Any suitable control circuit, as well known in the art, may be employed for controlling the corona discharge device 24.

Next, the charged portions of the photoreceptor surface are advanced through exposure station B. At exposure station B, the uniformly charged photoreceptor or charge retentive surface 12 is exposed to a raster output scanning device (or ROS) 26 which causes the charge retentive surface to remain charged or to be discharged in accordance with the laser beam output from the scanning device. An electronic subsystem converts a previously stored image into the appropriate control signals for the ROS in an imagewise fashion.

Figure 4A:
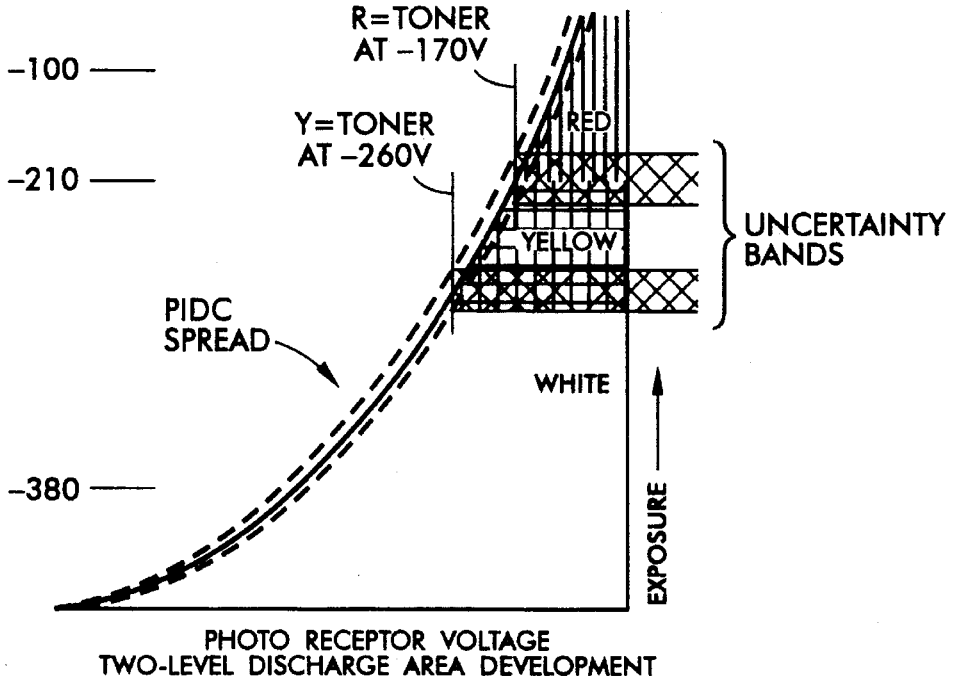
FIGS. 4A and 4B show the five voltage discharge levels obtained by the exposure system of the penta-level xerographic unit of FIG. 3 formed according to the present invention.
Figure 4B:
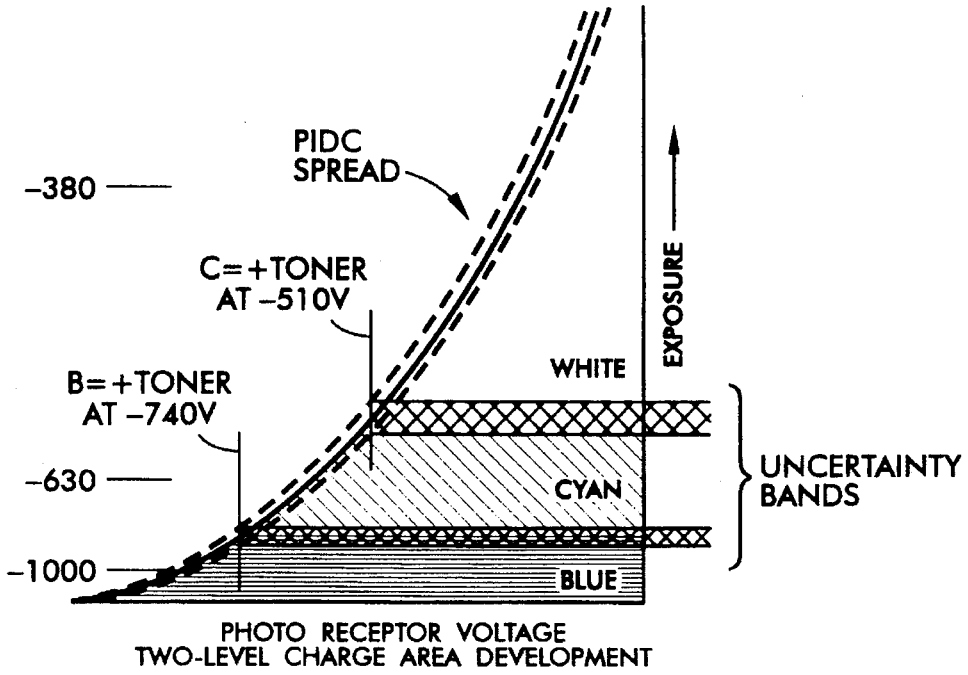

The laser beam 28 from the ROS 26 will expose the photoreceptor 12, discharging portions of the photoreceptor and resulting in a photoreceptor containing five or penta exposure levels such as that illustrated in FIGS. 4A and 4B. The five voltage levels remaining on the photoreceptor after exposure and discharge are approximately minus 1000 volts, minus 630 volts, minus 380 volts, minus 210 volts and minus 100 volts. These five voltage levels on the photoreceptor correspond to four image areas and a background or white area.

The minus 1000 volt level results from the laser beam of the ROS being turned off at that region of the photoreceptor so no exposure and discharge occurs there. The minus 100 volt level region received maximum exposure of the laser beam of the ROS so that the photoconductive discharges to its residual voltage level. The intermediate voltage levels of minus 630 volts, minus 380 volts, and minus 210 volts are obtained by using the laser beam of the ROS at intermediate power levels.

At development station C, a magnetic brush development system, indicated generally by the reference number 30, advances developer materials into contact with the electrostatic latent images on the exposure levels of the photoreceptor. The development system 30 comprises first, second, third and fourth developer housings 32, 34, 36 and 38. Preferably, each of these magnetic brush development housings includes two magnetic brush developer rollers. These rollers advance their respective developer materials into contact with the latent image. Each developer roller pair forms a brush comprising toner particles which are attracted by the latent images on the photoreceptor.

The four developer apparatuses 32, 34, 36 and 38 are provided for developing the four images areas with different color toners. The charge retentive surface of the photoreceptor 12 containing the images is moved past the four housings 32, 34, 36 and 38 of the development station C in a single pass. Color discrimination in the development of the electrostatic latent image is achieved by electrically biasing the four developer apparatuses 32, 34, 36 and 38 to suitable voltages for effecting the attraction of the four desired toners from the apparatuses to the five different charge voltage levels on the charge retentive surface of the photoreceptor.

By way of example, the first developer housing 32 contains positively charged black toner with an electrical bias to the housing set at minus 740 volts. Charge Area Development (CAD) is used. The black toner is attracted to the minus 1000 volt level areas of the photoreceptor and repelled from the other four voltage level charged areas of the photoreceptor. The positively charged black toner is attracted to the minus 1000 volt level areas of the photoreceptor which are more negatively charged than the minus 740 volt charged housing 32. Conversely, the positively charged black toner in the housing will not be attracted to the photoreceptor areas (of minus 630 volts, minus 380 volts, minus 210 volts and minus 100 volts) that are more positive than the housing bias of minus 740 volts.

As black toner moves to the photoreceptor, the voltage level of that area of the photoreceptor will approach and even come to equal the bias level of the black toner developer housing, minus 740 volts.

The second developer housing 34 contains positively charged cyan toner with an electrical bias to the housing set at minus 510 volts. Charge Area Development (CAD) is used. The cyan toner is attracted to the minus 740 volt level remaining on the photoreceptor after the black toner developer housing and the minus 630 volt level areas of the photoreceptor and repelled from the other three voltage level charged areas of the photoreceptor. The positively charged cyan toner is attracted to the minus 740 volt level areas of the photoreceptor which are more negatively charged than the minus 510 volt charged housing 34. The positively charged cyan toner is also attracted to the minus 630 volt level areas of the photoreceptor which are more negatively charged than the minus 510 volt charged housing 34. Conversely, the positively charged cyan toner in the housing will not be attracted to the photoreceptor areas (of minus 380 volts, minus 210 volts and minus 100 volts) that are more positive than the housing bias of minus 510 volts.

As cyan toner moves to the photoreceptor, the voltage level of that area of the photoreceptor will approach and even come to equal the bias, level of the cyan toner developer housing, minus 510 volts. Following passage of the black and cyan toner developer housings, the voltage levels on the photoreceptor will never be more negative than the cyan toner developer housing.

Despite the cyan toner being deposited upon the black toner in the minus 1000 volt level areas of the photoreceptor, the resulting color in those areas will still be black.

The third developer housing 36 contains negatively charged red toner with an electrical bias to the housing set at minus 170 volts. Discharge Area Development (DAD) is used. The red toner is attracted to the minus 100 volt level areas of the photoreceptor and repelled from the other four voltage level charged areas of the photoreceptor. The negatively charged red toner is attracted to the minus 100 volt level areas of the photoreceptor which are more positively charged (or less negatively charged) than the minus 170 volt charged housing 36. Conversely, the negatively charged red toner in the housing will not be attracted to the photoreceptor areas (of minus 1000 volts, minus 630 volts, minus 380 volts, and minus 210 volts) that are more negative than the housing bias of minus 170 volts.

As red toner moves to the photoreceptor, the voltage level of that area of the photoreceptor will approach and even come to equal the bias level of the red toner developer housing, minus 170 volts.

The fourth developer housing 38 contains negatively charged yellow toner with an electrical bias to the housing set at minus 260 volts. Discharge Area Development (DAD) is used. The yellow toner is attracted to the minus 170 volt level remaining following red toner development and also to the minus 210 volt level areas of the photoreceptor and repelled from the other voltage level charged areas of the photoreceptor which are more negative than minus 260 volts. The negatively charged yellow toner is attracted to the minus 170 volt level areas of the photoreceptor which are more positively (less negatively) charged than the minus 260 volt charged housing 38. The negatively charged yellow toner is also attracted to the minus 210 volt level areas of the photoreceptor which are more positively (less negatively) charged than the minus 260 volt charged housing 38. Conversely, the negatively charged yellow toner in the housing will not be attracted to the photoreceptor areas (of minus 1000 volts, minus 630 volts, and minus 380 volts) that are more negative than the housing bias of minus 260 volts.

Following passage of the red and yellow toner developer housings, the voltage levels on the photoreceptor will never be more positive than the minus 260 volt bias of the yellow toner developer housing.

Despite the yellow toner being deposited upon the red toner in the minus 100 volt level areas of the photoreceptor, the resulting color in those areas will still be red.

Thus, the charged area of minus 630 volts will attract a single toner from the housings 34. The charged area of minus 210 volts will attract a single toner from the housings 38. The charged area of minus 1000 volts will attract two toners from the housings 32 and 34. The charged area of minus 100 volts will attract two toners from the housings 36 and 38. The charged areas of the charge retentive surface of the photoreceptor of minus 380 volts are not developed by any of the toners from the four developer housings of the development station C because of the electrical bias of the toner housings and the polarities of the toners. This area typically becomes white.

Thus, the penta-level xerographic unit will produce resulting color images on the photoreceptor belt of black and white and red, yellow and cyan.

Because the composite image developed on the photoreceptor consists of both positive and negative toner, a positive pre-transfer corona discharge member 40 is provided to condition the toner for effective transfer to a substrate, using positive corona discharge. The pre-transfer corona discharge member is preferably an AC corona device, biased with a DC voltage to operate in a field sensitive mode, to perform xerography pre-transfer charging in a way that selectively adds more charge (or at least comparable charge) to the region of the composite image that must have its polarity reversed. This charge discrimination is enhanced by discharging the photoreceptor carrying the composite developed latent image with light before the pre-transfer charging this minimizes the tendency to overcharge portions of the image which are already at the correct polarity.

A sheet of support material 42 is moved into contact with the toner image at transfer station D. The sheet of support material is advanced to transfer station D by conventional sheet feeding apparatus, not shown. Preferably, sheet feeding apparatus includes a feed roll contacting the uppermost sheet of a stack of copy sheets. Feed rolls rotate so as to advance the uppermost sheet from stack into contact with photoconductive surface of the photoreceptor 14 in a timed sequence so that the toner powder image developed thereon contacts the advancing sheet of support material at transfer station D.

Transfer station D includes a corona generating device 44 which sprays ions of a suitable polarity onto the backside of sheet 42. This attracts the charged toner powder images from photoconductive surface 12 to sheet 42. After transfer, the sheet continues to move, in the direction of arrow 46, onto a conveyor (not shown) which advances the sheet to fusing station E.

Fusing station E includes a fuser assembly, indicated generally by the reference numeral 48, which permanently affixes the transferred powder image to sheet 42. Preferably, fuser assembly 48 comprises a heated fuser roller 50 and a back-up roller 52. Sheet 42 passes between fuser roller 50 and back-up roller 52 with the toner powder image contacting fuser roller 50. In this manner, the toner powder image is permanently affixed to sheet 42. After fusing, a chute, not shown, guides the advancing sheet 42 to a catch tray, also not shown, for subsequent removal from the printing machine by the operator.

After the sheet of support material is separated from photoconductive surface of belt 12, the residual toner toner particles and the wrong sign/color toner particles carried by the non-image areas on the photoreceptor are removed therefrom. These particles are removed from photoconductive surface at cleaning station F.

Subsequent to cleaning, a discharge lamp (not shown) floods the photoconductive surface with light to dissipate any residual electrostatic charge remaining prior to the charging thereof for the successive imaging cycle.

In the two stage Charge Area Development (CAD) of the penta-level xerographic unit, the first development should be positively charged black or an additive primary color (red, green or blue) with the electrical bias of the developer housing closest to the maximum possible voltage level on the photoreceptor. In this illustrative example, the housing is biased at minus 740 volts with the areas of the photoreceptor charged (and not exposed) at minus 1000 volts. The second development should be positively charged toner of a subtractive primary color (cyan, magenta or yellow) if the first development is red, green or blue with the electrical bias of the developer housing being the highest intermediate voltage. This highest intermediate voltage is less than the voltages of the two highest voltage levels on the photoreceptor. In this illustrative example, the housing is biased at minus 510 volts with the areas of the photoreceptor charged at minus 630 volts and at minus 1000 volts.

In the two stage Discharge Area Development (DAD) of the penta-level xerographic unit, the first development should be negatively charged black or an additive primary color (red, green or blue) with the electrical bias of the developer housing closest to the minimum possible voltage level (thus, the maximum exposure and discharge) on the photoreceptor. In this illustrative example, the housing is biased at minus 170 volts with the areas of the photoreceptor discharged (and exposed) at minus 100 volts. The second development should be negatively charged toner of a subtractive primary color (cyan, magenta or yellow) if the first development is red, green or blue with the electrical bias of the developer housing being the lowest intermediate voltage. This lowest intermediate voltage is greater than the voltages of the two lowest voltage levels on the photoreceptor. In this illustrative example, the housing is biased at minus 260 volts with the areas of the photoreceptor charged at minus 210 volts and minus 100 volts.

The sequencing on colors in the first and second development within CAD development and within DAD development in the penta-level follows the same rules.

If the first development toner in either DAD or DAD is black, then the second development toner can be any of the subtractive primary colors of cyan, yellow or magenta. Actually if the first development toner is black, then the second development toner can be any of the additive primary color of red, green or blue also. Any color toner deposited on black toner will still produce black color.

If the first development toner is the additive primary color of blue, then the second development toner can be cyan or magenta but ordinarily not the opposite subtractive primary color to blue of yellow which combined would form an imperfect black or other impure very dark color. Cyan or magenta toner deposited upon blue toner will produce blue color.

If the first development toner is the additive primary color of red, then the second development toner can be yellow or magenta but ordinarily not the opposite subtractive primary color to red of cyan. Yellow or magenta toner deposited upon red toner will produce red color.

If the first development toner is the additive primary color of green, then the second development toner can be cyan or yellow but ordinarily not the opposite subtractive primary color to green of magenta. Cyan or yellow toner deposited upon green toner will produce green color.

White is produced by the middle exposure or voltage level between the two CAD and the two DAD development areas and voltages by no toner being deposited on the photoreceptor and the sheet of support material being white.

It is not essential that the Charge Area Development (CAD) occur before the Discharge Area Development (DAD). The Discharge Area Development (DAD) can occur first in the penta-level xerographic unit.

Also, the penta-level xerographic unit can have the first CAD deposition of toner, followed by the first DAD deposition of toner, followed by either the second CAD or the second DAD deposition of toner, followed by the remaining second CAD or the second DAD deposition of toner. The only requirement for the sequencing of toner deposition is that the black or additive primary color in both the CAD and DAD development must be deposited prior to the subtractive primary color in that area development.

Alternatively, rather than an additive primary color in the first of the two CAD or DAD development steps, a subtractive primary color may be used. In this alternative embodiment, toners of the two subtractive primary colors would combine to form a toner of an additive primary color. Thus, the end result would be the same with the two step CAD or DAD development still producing toners of one additive primary color and one subtractive color.

For example, in FIG. 3, the third developer housing 36 could have magenta toner rather than red. The fourth developer housing 38 would still have yellow toner. The third developer housing 36 would still have an electrical bias set at minus 170 volts. Discharge Area Development (DAD) is still used. The magenta toner is attracted to the minus 100 volt level areas of the photoreceptor and repelled from the other four voltage level charged areas of the photoreceptor.

The fourth developer housing 38 would still have an electrical bias set at minus 260 volts. Discharge Area Development (DAD) is still used. The yellow toner would still be attracted to the minus 100 volt level and the minus 210 volt level areas of the photoreceptor and repelled from the other three voltage level charged areas of the photoreceptor.

The minus 210 volt areas of the photoreceptor would have only yellow toner, the minus 100 volt areas would have yellow and magenta toners forming the color red.

Similarly, magenta and cyan toners form blue and cyan and yellow toners form green.

This holds true for Charge Area Development (CAD) as well. The end result is still toners of one additive primary color and one subtractive color.

The specific voltages used in this application are merely illustrative examples. The actual voltages for the five exposure levels and the biasing of the developer housings merely have to be sufficiently different for the appropriate colored toner from the developer housing to be attracted to the area of the appropriate exposure level on the photoreceptor.

The photoreceptor belt of the present invention can, in the alternative, be a drum photoreceptor or other equivalents. The rotating polygon raster output scanner (ROS) optical system can, in the alternative, be a LED image bar or other equivalents.

While the invention has been described in conjunction with specific embodiments, it is evident to those skilled in the art that many alternatives, modifications and variations will be apparent in light of the foregoing description. Accordingly, the invention is intended to embrace all such alternatives, modifications and variations as fall within the spirit and scope of the appended claims.

What is claimed is:

1. An apparatus for forming color images on a charge retentive surface in a single pass, said apparatus comprising:

means for uniformly charging said charge retentive surface, means for exposing said uniformly charged surface to form a five level latent electrostatic charge pattern thereon, means for developing a first one of said five levels to form a first toner image of a first color thereon, means for developing a second one of said five levels to form a second toner image of a second color thereon, means for developing a third one of said five levels to form a third toner image of a third color thereon, means for developing a fourth one of said five levels to form a fourth toner image of a fourth color thereon, and means for transferring said toner images simultaneously to a substrate.

2. The apparatus for forming color images on a charge retentive surface in a single pass of claim 1 wherein said first and second toners have opposite polarities from said third and fourth toners.

3. The apparatus for forming color images on a charge retentive surface in a single pass of claim 1 wherein said developing means for said first and second toners is Charge Area Development and said developing means for said third and fourth toners is Discharge Area Development.

4. The apparatus for forming color images on a charge retentive surface in a single pass of claim 1 wherein at least one of said toner colors combines with another of said toner colors to form a toner image of a third color.

5. The apparatus for forming color images on a charge retentive surface in a single pass of claim 1 wherein none of said toner colors combines with another of said toner colors to form a toner image of a third color.

6. The apparatus for forming color images on a charge retentive surface in a single pass of claim 1 wherein said toner colors are black and the subtractive primary colors.

7. The apparatus for forming color images on a charge retentive surface in a single pass of claim 1 wherein said toner colors are black and at least one of the additive primary colors.

8. The apparatus for forming color images on a charge retentive surface in a single pass of claim 1 wherein said first and third toner colors are black or additive primary colors and said second and fourth toner colors are subtractive primary colors.

9. The apparatus for forming color images on a charge retentive surface in a single pass of claim 1 wherein said toner colors are subtractive primary colors.

10. An apparatus for forming color images on a charge retentive surface in a single pass, said apparatus comprising:

means for uniformly charging said charge retentive surface, means for exposing said uniformly charged surface to form a five level latent electrostatic charge pattern thereon, charge area development means for developing two of said five levels to form two toner images of two different colors thereon, discharge area development means for developing two of said five levels to form two toner images of two different colors thereon, and means for transferring said toner images simultaneously to a substrate.

* * * * *